US005520485A

United States Patent [19]

Hermansen

[11] Patent Number: 5,520,485

[45] Date of Patent: May 28, 1996

[54] POWER INFLATOR ASSEMBLY FOR BUOYANCY COMPENSATOR

[75] Inventor: Frank Hermansen, Costa Mesa, Calif.

[73] Assignee: QDS Enterprises, Inc., Carlsbad, Calif.

[21] Appl. No.: 287,178

[22] Filed: Aug. 8, 1994

[51] Int. Cl.[6] ..... B63C 11/18

[52] U.S. Cl. ..... 405/186; 441/96; 441/99

[58] Field of Search ..... 405/186, 185; 441/90, 92, 96, 99

[56] References Cited

U.S. PATENT DOCUMENTS

| | | | |
|---|---|---|---|
| 3,436,777 | 4/1969 | Greenwood | 9/342 |
| 3,727,250 | 4/1973 | Koehn et al. | 405/186 |
| 3,898,705 | 8/1975 | Schuler | 405/186 |
| 3,964,266 | 6/1976 | Bartlett | 61/70 |
| 4,054,132 | 10/1977 | Deeds | 128/142 |
| 4,114,389 | 9/1978 | Bohmrich et al. | 405/186 |
| 4,137,585 | 2/1979 | Wright, III | 9/314 |
| 4,176,418 | 12/1979 | Scott | 9/313 |
| 4,227,521 | 10/1980 | Hart et al. | 128/202.14 |
| 4,324,507 | 4/1982 | Harrah | 405/186 |
| 4,379,656 | 4/1983 | Darling | 405/186 |
| 4,437,790 | 3/1984 | Trop | 405/186 |
| 4,529,333 | 7/1985 | Robinette | 405/186 |
| 4,681,552 | 7/1987 | Courtney | 441/92 |
| 4,720,281 | 1/1988 | Matsuoka | 441/92 |

*Primary Examiner*—Ramon S. Britts
*Assistant Examiner*—Frederick L. Lagman
*Attorney, Agent, or Firm*—Brown, Martin, Haller & McClain

[57] ABSTRACT

A power inflator housing has a pressurized gas inlet for connection to a gas supply hose, an inflation outlet for connection to a buoyancy compensator inflation hose, a passageway connecting the gas inlet to the inflation outlet, and a valve actuating stem extending through part of the passageway into the gas inlet for selectively actuating a control valve at the outlet end of a gas supply hose coupled to the gas inlet. A manually operable button on the housing is linked to the stem for selectively urging the stem outwardly into an operative position to open the hose control valve. The stem is biassed towards an inoperative, retracted position.

16 Claims, 2 Drawing Sheets

POWER INFLATOR ASSEMBLY FOR BUOYANCY COMPENSATOR

BACKGROUND OF THE INVENTION

The present invention relates generally to buoyancy compensators for use in diving and is particularly concerned with a power inflator assembly for controlling inflation of a buoyancy compensator.

A buoyancy compensator is an inflatable vest or jacket worn by a diver as an auxiliary means of buoyancy control and for providing emergency flotation of a diver. The buoyancy compensator is normally provided with a power or automatic inflator valve assembly which controls connection of the buoyancy compensator to a pressurized air supply and to an exhaust outlet, so that air can be selectively supplied to the buoyancy compensator or exhausted from the buoyancy compensator for controlling buoyancy. A safety valve is also normally provided to automatically vent the buoyancy compensator if filled with an excessive amount of air. The safety valve can also be manually opened by the diver as desired to vent air from the buoyancy compensator.

Most power inflators have an internal valve member operated by a control button to control connection of a pressurized air chamber in the housing to the buoyancy compensator inflation hose. Thus, pressurized air is always present inside the housing, requiring high pressure seals to trap the pressurized air, and a relatively complex assembly with several valve parts.

SUMMARY OF THE INVENTION

It is an object of the present invention to provide a new and improved power inflator for a buoyancy compensator.

According to the present invention, a power inflator assembly is provided which comprises a housing having a first, pressurized air inlet for connection to a hose connected to a pressurized air supply, an exhaust outlet, and an inflation outlet for connection to an inflation hose which is in turn connected to a fill inlet of a buoyancy compensator. The housing has a connecting passageway which connects the pressurized air inlet to the inflation outlet. A manually operated control button is mounted on the housing and has a stem extending through the housing to the pressurized air inlet. The stem has an outer end for actuating a valve in the end of a hose connected to the pressurized air inlet when the control button is depressed so as to supply pressurized air from the hose through the connecting passageway to the inflation outlet. The button and stem are movable between a first, retracted position when the button is not depressed in which the outer end of the stem is spaced from a valve in the end of a connected hose, and a second, operative position when the button is depressed, in which the outer end of the stem contacts and opens the valve.

This arrangement uses only the existing, standard Schrader valve in the end of a high pressure hose for controlling supply of air to the buoyancy compensator, and does not require a separate valve inside the power inflator housing. There will be no high pressure air from the tank held inside the housing at any time, unlike the prior art arrangements using a valve inside the housing to control input to the buoyancy compensator. There is therefore no need for relatively complex seal arrangements for preventing leakage of pressurized air. In conventional, prior art power inflators, the high pressure hose inlet fitting had an actuator for automatically opening the hose Schrader valve as soon as the hose was connected to the power inflator. In this invention, the actuator is eliminated so that the hose Schrader valve remains closed until actuated by depression of the control button.

In a preferred embodiment of the invention, the pressurized air inlet is at an upper end of the housing and the control button is located on one side of the housing. The stem is of flexible material and a guide insert is mounted in the housing for slidably guiding the stem around a 90° bend for extending from the control button to the pressurized air inlet. The insert may be in two halves for ease of manufacture.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
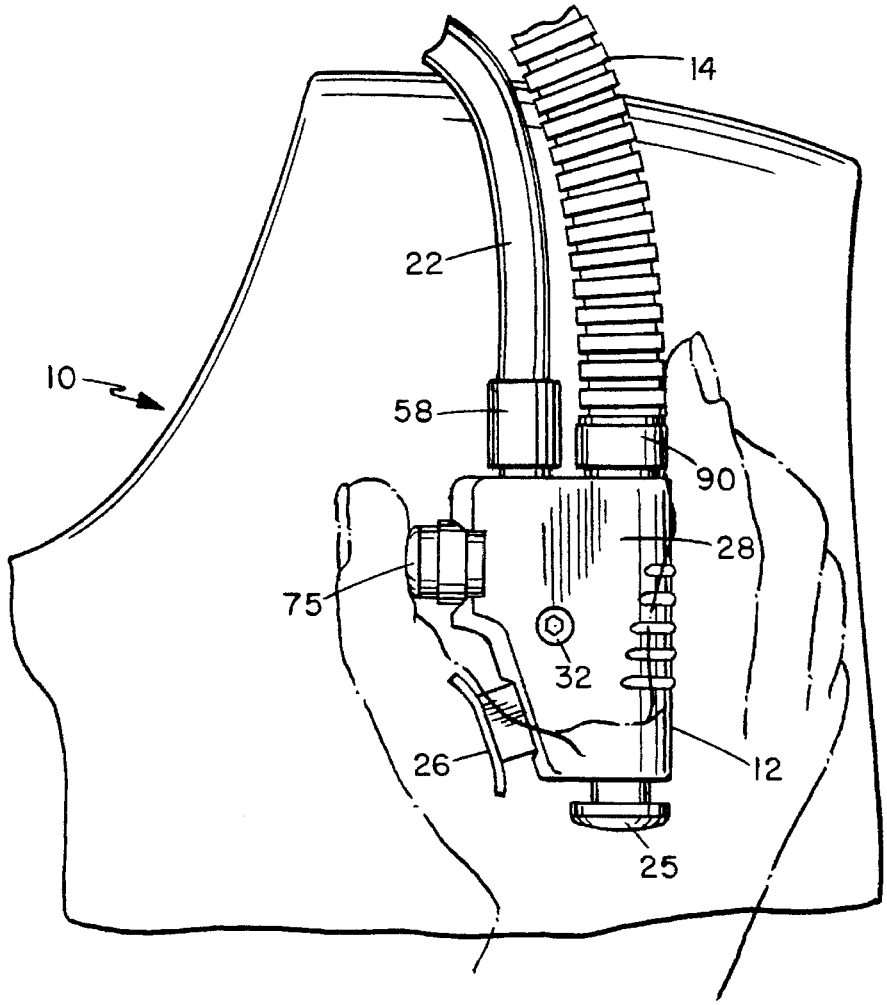
FIG. 1 is a front view of the power inflator unit according to a preferred embodiment of the invention in use, showing the activation.

FIG. 1 of the drawings illustrates one shoulder of a buoyancy compensator vest 10 to which a power inflator unit 12 according to a preferred embodiment of the present invention is connected via expandable inflation hose 14 which extends upwardly from inflator 12 over the shoulder to a fill inlet of the vest 10 via a safety valve (not illustrated). The inflatable vest will be of suitable waterproof material and is an inflatable bladder of conventional construction. The power inflator controls supply of pressurized gas to the vest and bleeding of gas from the vest for buoyancy control. The safety valve may be of conventional construction or may be a safety valve as described in my co-pending application entitled "Safety Valve for Buoyancy Compensator" filed on even date herewith, the contents of which are incorporated herein by reference.

Figure 2:
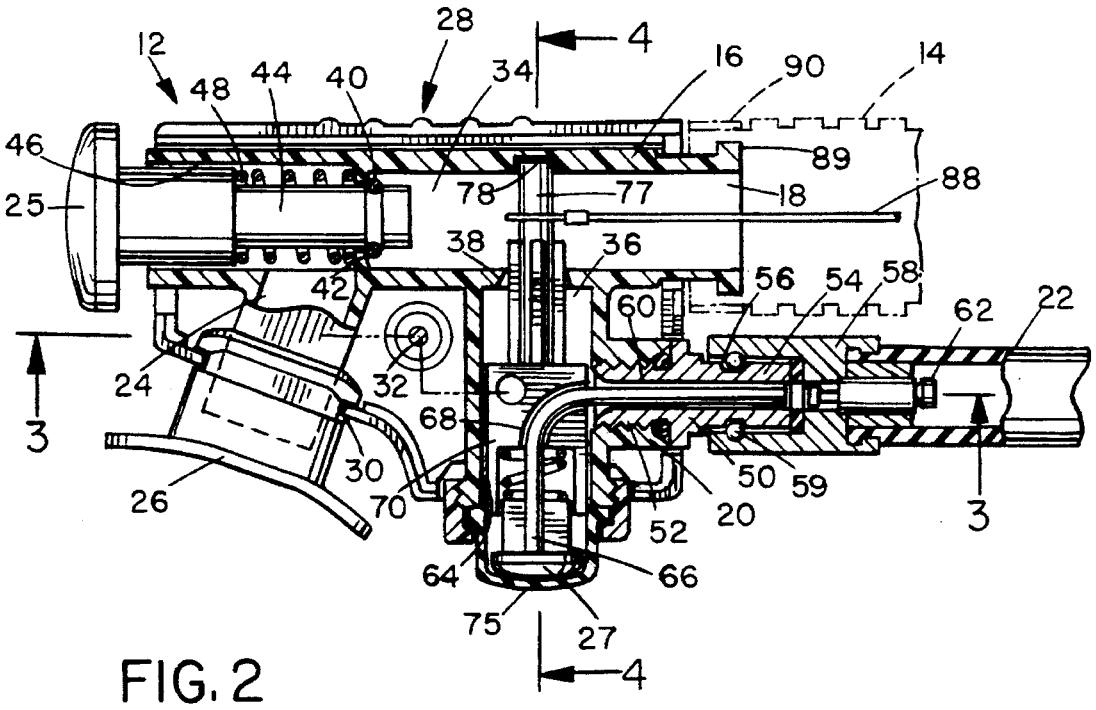
FIG. 2 is a side elevation view with one outer shell half removed and portions cut away.

As best illustrated in FIG. 2, the power inflator 12 basically comprises an outer housing 16 having a first, inflation outlet 18 for connection to one end of hose 14, a pressurized air inlet 20 for connection to an outlet end of a pressurized air hose 22, and a second, vent outlet 24 in which a mouthpiece 26 is mounted. The power inflator also has an exhaust button 25 projecting through an opening 46 in the lower end of the housing 18, and a power or inflation button 27 projecting through an opening 64 to one side of the housing as oriented in FIG. 1. The housing 16 is enclosed in a two piece outer shell or casing 28 which engages a channel 30 in mouthpiece 26 to secure the mouthpiece in vent outlet 24. The outer shell is shaped to conform substantially to the outer periphery of housing 16 and the two halves of the shell are releasably secured together via fastener screw 32, as best illustrated in FIG. 3.

FIG. 1 illustrates the power inflator 12 oriented as it will be in use, with the inflation outlet 18 and pressurized air inlet 20 located side-by-side at the upper end of the housing for connection to the hoses 14 and 22 which extend upwardly over the diver's shoulder for connection to the vest fill inlet and to a pressurized air tank carried on the diver's back, respectively. As best illustrated in FIG. 2, the housing 16 is basically cylindrical with a side branch forming a T-junction, the inflation button 27 being located at the end of the side branch. A first, straight cylindrical passageway or chamber 34 extends from the inflation outlet 18 to the vent outlet 24 and exhaust button 25, and a second, transverse passageway or chamber 36 extends from inflation button 27 into chamber 34 via opening 38, with the pressurized air inlet 20 extending transversely into chamber 36. A valve member 40 normally rests against valve seat 42 in chamber 34 to cut off communication between the inflation outlet 18 and the vent outlet 24. A valve stem 44 connects the valve member 40 to the exhaust button 25, which is slidably mounted in opening 46 at the lower end of the housing. A spring 48 biasses valve member 40 against valve seat 42 to normally close the valve. Valve member 40 may be opened by depression of exhaust button 25 in order to let air out or in order to orally supply air to the buoyancy compensator by blowing in through mouthpiece 28 in a conventional manner. Depression of button 25 to move the valve member 40 away from the seat 42 allows air to exhaust from the buoyancy compensator and flow back through the power inflator to mouthpiece 26.

Figure 3:
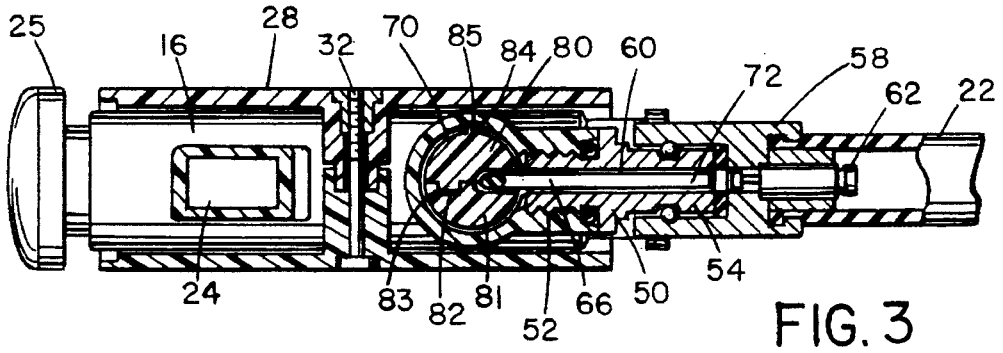
FIG. 3 is a sectional view taken on line 3—3 of FIG. 2.
Figure 6:
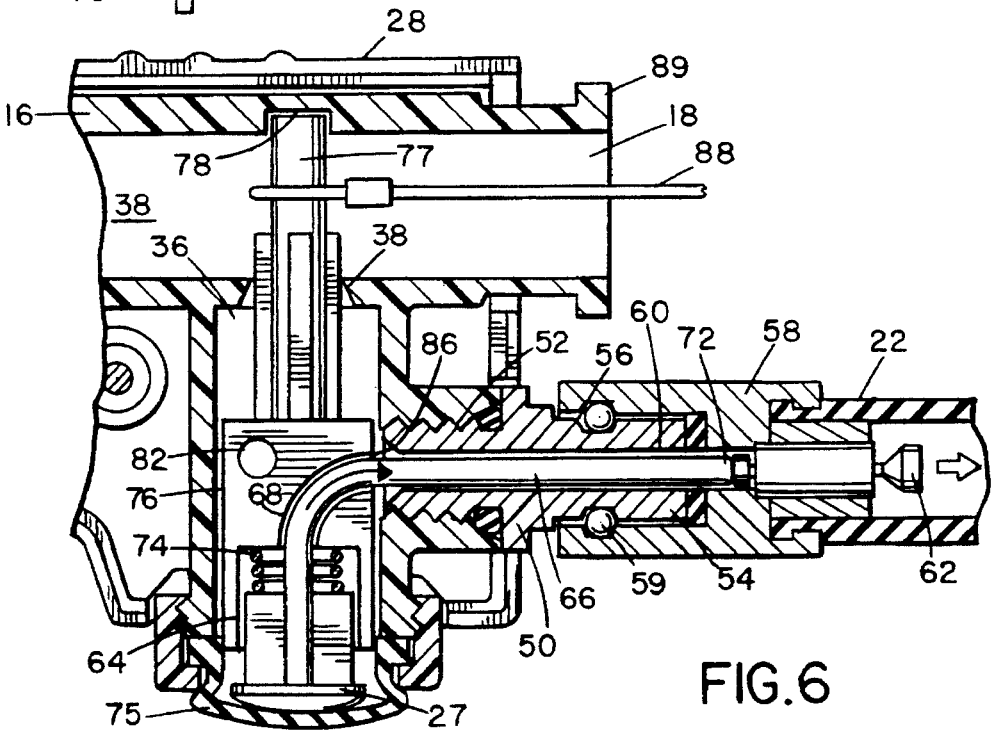
FIG. 6 is an enlargement of a portion of FIG. 2, showing the valve actuation.

The end of pressurized air hose 22 is connected to the air inlet 20 of the housing via inlet fitting 50 which has a first, threaded end 52 for threaded engagement with internal screw threads in air inlet 20, and a second, outwardly projecting end 54 having a groove or channel 56, as illustrated in FIGS. 2, 3 and 6. A conventional air hose end fitting or coupling sleeve 58 is engageable over the second end portion 54 of fitting 50 as illustrated in FIGS. 2 and 3, so that internal balls 59 in the ring 58 snap into channel 56. Fitting 50 has a through bore 60.

A conventional Schrader valve 62 is mounted in the end of air hose 22 for normally cutting off flow of pressurized air out of hose 22. In most prior art power inflators, this valve is automatically opened as soon as the hose is coupled to the power inflator housing, via a suitable actuator on the inlet fitting. Thus, in prior art power inflators, pressurized air is supplied into the housing immediately on coupling to the air supply hose. In contrast, in the power inflator of this invention, the arrangement is such that Schrader valve 62 remains closed as illustrated in FIG. 2 and 3 when first connected to the housing, and is opened only by depression of inflation button 27 which is slidably mounted in the opening 64 in housing 16. A flexible stem 66 extends from button 27 through guide passageway 68 in a cylindrical insert 70 in chamber 36 and into the through bore 60 in fitting 50. The outer end 72 of the stem is located adjacent Schrader valve 62 when the button is in the released or inoperative position illustrated in FIG. 2. The stem 66 must make a 90° bend in order to extend from button 27 to one side of the housing up to the inlet 20 at the upper end of the housing, and the insert passageway 68 therefore has a 90° bend for slidably guiding the stem 66 into alignment with bore 60. The button 27 is biassed outwardly into the inoperative position via return spring 74 which extends between an end face of insert 70 and the power button 27. The button 27 is retained in the housing via a flexible cap 75 which is secured in the opening over power button 27.

Although in the preferred embodiment button 27 is at an angle of 90° to the Schrader valve, requiring the stem 66 to make a turn of 90°, the button may be angled differently in alternative embodiments, for example at less than or greater than 90°, so that the bend in the stem may be between 80° and 110°, for example. However, a 90° angle has the advantage of placing button 27 in a convenient position for actuation by the user as in FIG. 1.

As can be seen in FIGS. 2 and 6, the stem 66 slides through passageway 68 and bore 60 with some clearance. Thus, when button 27 is depressed, stem 66 will be pushed outwardly through passageway 68 and bore 60 to engage and open Schrader valve 62, as illustrated in FIG. 6. This in turn allows pressurized air to flow through bore 60 and into chamber 36, and from there through opening 38 into chamber 34 and out via outlet 18 into inflation hose 14 in order to inflate the buoyancy compensator. As soon as button 27 is released, it will be biassed back outwardly, retracting stem 66 and allowing the Schrader valve 62 to close and cut off the pressurized air supply. Thus, no high pressure air will be held in housing 16, and there is less risk of air leakage through the power inflator housing.

Figure 4:
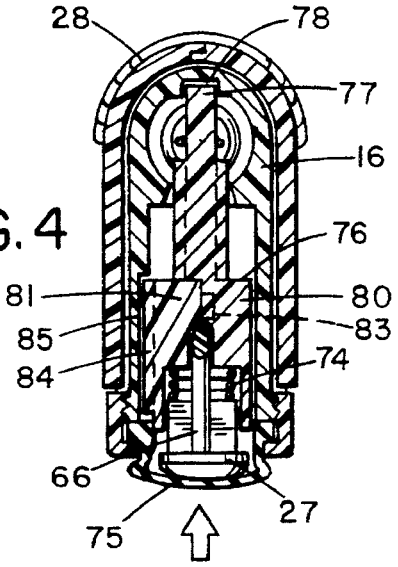
FIG. 4 is a sectional view taken on line 4—4 of FIG. 2.
Figure 5:
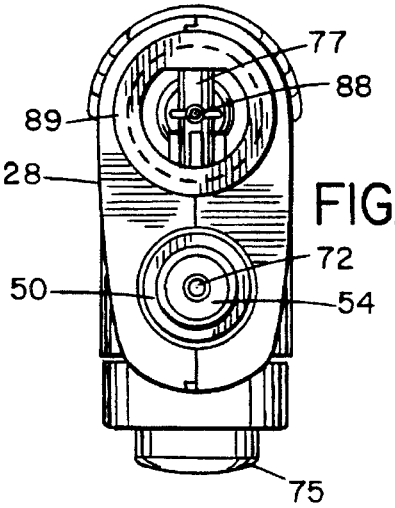
FIG. 5 is an end view of the valve unit from the connection end.

The insert 70 has an enlarged cylindrical end portion or head 76 which fits in chamber 36 with some clearance, and a reduced diameter shaft 77 which extends from head 76 through opening 38 and transversely across chamber 34. The end of shaft 77 seats in a recess 78 provided in the wall of chamber 34 diametrically opposite opening 38, as best illustrated in FIGS. 4 and 6. The enlarged head 76 of insert 70 is split diametrically into the two opposing halves 80,81 for ease in forming the bent guide passageway 68, with the shaft 77 extending from half or part 80, as illustrated in FIGS. 3 and 4. The two halves 80,81 are releasably retained together in the chamber 36 with the opposing halves of passageway 68 in alignment by means of hole 82 in the flat face of one half 81 and an aligned pin or projection 83 on the other half 80 which extends into hole 82 as illustrated in FIG. 3 when the two halves are accurately aligned in face-to-face engagement. The insert 70 also has an axially extending alignment rib 84 for engagement in a corresponding groove 85 in chamber 36 to ensure that the outlet end 86 of passageway 68 is accurately aligned with the through bore 60 of fitting 50 when the insert 70 is installed in the housing, as best illustrated in FIG. 3.

The projecting shaft 77 of the guide insert serves as the anchor for the end of a pull-dump cable 88 which extends from the power inflator through hose 14 for connection to a safety valve (not illustrated). Such pull-dump cables are conventional in diving buoyancy compensators and typically are secured at one end to a pin extending through the chamber 34 and at the opposite end to a safety valve member, whereby a diver can open the safety valve in an emergency simply by pulling down on the power inflator. The projecting shaft 77 of the guide insert in this invention avoids the need for a separate pin projecting through the housing for anchoring the pull-dump cable, and thus eliminates additional holes in the housing, reducing the risk of leaks. The end of cable 88 is simply looped or tied around shaft 77 as illustrated in FIGS. 2 and 6.

The inflation outlet 18 of the housing has an outer annular rim or lip 89 over which the end of hose 14 engages, as illustrated in FIG. 2. An outer hose lock or retainer ring 90 engages over the hose 14 to secure the hose to the housing 16, as best illustrated in FIGS. 1 and 2. This replaces the more conventional panduit clamp which is conventionally used in prior art power inflators.

In order to operate the power inflator to inflate the buoyancy compensator or regulate the buoyancy of a diver, the diver simply reaches up and grasps the power inflator as illustrated in FIG. 1, using the thumb or fingers to depress power button 27 easily. The location of power button 27 to one side of the housing is critical since it will be easier to push and actuate in this location than if it were positioned at the lower end of housing 16, for example, since the user can grasp the opposite side of the housing for resistance to permit proper actuation in a comfortable, natural manner. As illustrated in FIG. 1, the user or diver simply reaches up, grasps the inflator, and presses button 27 inwardly, in the direction of the arrow as illustrated in FIG. 4. Spring 74 will be compressed, and stem 66 will be pushed along passageway 68 and through bore 60 until the end 72 engages the Schrader valve and pushes it outwardly to open the valve as illustrated in FIG. 6. Pressurized air then exits the resultant opening or clearance in the end of hose 22, and flows through the clearance in bore 60, through chamber 36 and opening 38 into chamber 34 and out through opening 18 into hose 14. Pressurized air is thus supplied to the jacket 10 until the pressure on button 27 is released. At that point, spring 74 biasses button 27 back outwardly, retracting stem 66 into the position illustrated in FIGS. 2 and 3 and allowing the Schrader valve 62 to close, cutting off air supply to the housing 16.

As mentioned above, all buoyancy compensators typically have a safety valve for emergency venting of the buoyancy compensator and for automatically venting excess air from the buoyancy compensator in the event of excessive pressure. The safety valve is typically linked to the power inflator via a pull dump cable so that the diver simply pulls down on the power inflator housing in order to open the safety valve in an emergency situation where they wish to surface quickly. In the present invention, as noted above, one end of a pull dump cable 88 is linked to the shaft 77 of the insert 70. The opposite end of cable 88 may be linked to the valve member of a conventional safety valve, but is preferably linked to a safety valve as described in my co-pending application referred to above which was filed on even date herewith.

The buoyancy compensator power inflator of this invention is of much simpler construction and requires fewer parts than prior art power inflators. Because the Schrader valve at the outlet end of the pressurized air hose is not opened when the hose is coupled to the inflator housing, there will be no high pressure air held within the housing at any time, and thus less risk of leakage. The use of existing supply hose valve to control supply of gas to the buoyancy compensator via the power inflator avoids the need for an additional valve in the housing, and further reduces the number of moving parts needed. The positioning of the inflation button to one side of the housing makes the inflator easy to operate to fill the buoyancy compensator to the desired buoyancy level. The use of an outer, two part casing enclosing the power inflator housing reduces the risk of damage to the housing and also allows the mouthpiece to be held in the housing vent outlet without use of adhesive or other securing means. The outer casing also acts to lock retainer ring 90 over the end of hose 14, avoiding the need for a panduit clamp to hold hose 14 on the housing outlet 18. Coupling of the power inflator to a pull-dump cable is also simplified by providing a shaft extending from the guide insert to provide an anchor for the cable, avoiding the need for extra openings in the housing.

Although a preferred embodiment of the invention has been described above by way of example only, it will be understood by those skilled in the field that modifications may be made to the disclosed embodiment without departing from the scope of the invention, which is defined by the appended claims.

I claim:

1. A power inflator assembly for a buoyancy compensator, comprising:

a housing having a pressurized gas inlet, an inflation outlet for connection to an inflation hose for supplying pressurized gas to a buoyancy compensator fill inlet, and an internal passageway connecting the pressurized gas inlet to the inflation outlet;

a gas supply hose having a first end for connection to a pressurized gas supply and a second end connected to said pressurized gas inlet;

a control valve in the second end of said supply hose, said control valve being movable between a closed position blocking supply of pressurized gas to said housing and an open position allowing pressurized gas to flow through said internal passageway to said inflation valve, said control valve being normally in said closed position;

a valve actuating stem in said housing having an outer end extending through said pressurized gas inlet out of said housing and into the second end of said supply hose for actuating said control valve, said stem being movable between a first, inoperative position in which said control valve is closed and a second, operative position in which the outer end of said stem engages and opens the control valve to supply pressurized gas through said pressurized gas inlet and the passageway to the inflation outlet;

manually operable means on the housing for urging the stem into the operative position; and biassing means in said housing for biassing the stem into the inoperative position, whereby no pressurized gas is supplied to the housing until the stem is moved to the operative position.

2. The assembly as claimed in claim 1, wherein said housing has an upper end, a lower end and opposite sides, said gas inlet and inflation outlet being located at the upper end of the housing, said housing having an opening at one side communicating with said internal passageway, and said manually operable means extending through said opening.

3. The assembly as claimed in claim 1, wherein the housing has a vent outlet, a second passageway connecting said inflation outlet to said vent outlet, valve means in said second passageway normally closing said second passageway, and manually operable means on said housing for opening said valve means to vent gas from a buoyancy compensator connected to said inflation outlet.

4. The assembly as claimed in claim 3, including an outer casing enclosing said housing and having openings aligned with said inlet and outlets.

5. The assembly as claimed in claim 4, wherein said casing is in two parts and includes securing means for securing the casing parts together.

6. The assembly as claimed in claim 5, including a mouthpiece secured in said vent outlet, said casing including securing means for retaining said mouthpiece in said vent outlet.

7. The assembly as claimed in claim 1, wherein said inflation outlet and gas inlet are oriented parallel to one another and face in the same direction from said housing, said connecting passageway including a first portion aligned with said inflation outlet and a second portion adjoining said first portion and extending perpendicular to said first portion, said gas inlet communicating with said second passageway portion and said manually operable means being aligned with said second portion, said valve actuating stem comprising a flexible member extending along a path including a 90° bend from said manually operable means to said gas inlet.

8. The assembly as claimed in claim 7, including guide means in said second passageway portion for guiding said flexible stem from said manually operable means to said inlet.

9. The assembly as claimed in claim 8, wherein said guide means comprises an insert member having a first end facing said manually operable means and a side portion extending across said gas inlet, and a guide passageway having a 90° bend extending from said first end through said side portion, said stem extending slidably through said guide passageway, and said guide passageway having an outlet end aligned with said gas inlet.

10. The assembly as claimed in claim 9, wherein said insert member has an enlarged head in said second passageway portion and a reduced diameter shaft extending from said head into said first passageway portion, said guide passageway being located in said enlarged head, and said shaft extending transversely across said first passageway portion, said shaft comprising means for attaching to the end of a pull-dump cable extending through an expandable inflation hose secured to said inflation outlet.

11. A power inflator assembly for a buoyancy compensator, comprising:

a housing having a pressurized gas inlet for connection to the end of a hose connected to a pressurized gas supply and an inflation outlet for connection to an inflation hose for supplying pressurized gas to a buoyancy compensator fill inlet;

the housing having an internal passageway connecting the pressurized gas inlet to the inflation outlet;

a valve actuating stem in said housing extending through said pressurized gas inlet for actuating a control valve in the end of a supply hose coupled to said inlet, said stem being movable between a first, inoperative position in which the supply hose control valve is closed and a second, operative position in which said stem engages and opens the hose control valve to supply pressurized gas through the passageway to the inflation outlet;

manually operable means on the housing for urging the stem into the operative position;

biassing means in said housing for biassing the stem into the inoperative position;

said housing having an opening communicating with said internal passageway, and said manually operable means extending through said opening; and said manually operable means comprising a push button slidably mounted in said opening, and said stem being of flexible material and having a first end secured to said push button, said stem extending from said push button through a bend into said inlet.

12. The assembly as claimed in claim 11, including a guide member mounted in said passageway having a first end adjacent said opening and a side portion extending across said inlet, said guide member having a guide passageway extending from said first end to said side portion, the guide passageway having a bend and having cross-sectional dimensions greater than the cross-sectional dimensions of said stem, said stem extending slidably through said passageway to said inlet.

13. The assembly as claimed in claim 12, wherein said guide member is cylindrical and is formed in two diametrically split halves.

14. A power inflator assembly for a buoyancy compensator, comprising:

a housing having a pressurized gas inlet for connection to the end of a hose connected to a pressurized gas supply and an inflation outlet for connection to an inflation hose for supplying pressurized gas to a buoyancy compensator fill inlet;

the housing having an internal passageway connecting the pressurized gas inlet to the inflation outlet;

a valve actuating stem in said housing extending through said pressurized gas inlet for actuating a control valve in the end of a supply hose coupled to said inlet, said stem being movable between a first, inoperative position in which the control valve is closed and a second, operative position in which said stem engages and opens the control valve to supply pressurized gas through the passageway to the inflation outlet;

manually operable means on the housing for urging the stem into the operative position;

biassing means in said housing for biassing the stem into the inoperative position;

said connecting passageway including a first portion aligned with said inflation outlet, a second portion extending transverse to said first portion, said gas inlet communicating with said second portion, an insert member mounted in said second portion and having a shaft portion extending from said insert member into said first passageway portion, and a pull-dump cable having a first end secured to said shaft portion of said insert member and extending out of said housing through said inflation outlet.

15. A power inflator assembly for a buoyancy compensator, comprising:

a housing having a pressurized gas inlet for connection to a gas supply hose, an inflation outlet for connection to a buoyancy compensator fill inlet, and an internal passageway connecting said gas inlet to said inflation outlet;

a manually operable push button on said housing for controlling supply of gas from a gas supply hose into said gas inlet, said push button being oriented perpendicular to said gas inlet;

a flexible valve actuating stem extending from said push button to said gas inlet in a path having a bend;

said push button and stem being movable between an inoperative, retracted position and an operative position in which said stem projects outwardly from said gas inlet to engage and open a control valve in a supply hose coupled to said gas inlet to supply gas through said passageway to said inflation outlet; and biassing means urging said stem and push button into said inoperative position.

16. The assembly as claimed in claim 15, wherein the bend is a 90° bend.

* * * * *